US012279662B2

(12) United States Patent
Camberos

(10) Patent No.: US 12,279,662 B2
(45) Date of Patent: Apr. 22, 2025

(54) BATH GRIDLE BRIEFS

(71) Applicant: Liz Alejandra Perez Camberos, Tijuana (MX)

(72) Inventor: Liz Alejandra Perez Camberos, Tijuana (MX)

( * ) Notice: Subject to any disclaimer, the term of this patent is extended or adjusted under 35 U.S.C. 154(b) by 243 days.

(21) Appl. No.: 18/048,907

(22) Filed: Oct. 24, 2022

(65) Prior Publication Data

US 2024/0130445 A1 Apr. 25, 2024
US 2024/0225142 A9 Jul. 11, 2024

(51) Int. Cl.
*A41D 7/00* (2006.01)

(52) U.S. Cl.
CPC ..... *A41D 7/005* (2013.01); *A41D 2400/38* (2013.01)

(58) Field of Classification Search
CPC ..... A41D 7/005; A41D 7/00; A41D 2400/35; A41B 2400/38; A41C 1/003; A41C 1/08
See application file for complete search history.

(56) References Cited

U.S. PATENT DOCUMENTS 1,494,767 A * 5/1924 Biehl ..... A41F 9/002 2/237
2,102,323 A * 12/1937 Kneibler ..... A41D 7/005 D2/738
2,297,955 A * 10/1942 Greene ..... A41C 1/08 450/134
2,410,082 A * 10/1946 Kispert ..... A41C 1/08 450/129
2,464,452 A * 3/1949 Kispert ..... A41C 1/08 450/129
2,583,865 A * 1/1952 McIlhinney ..... A41D 7/00 450/8
2,661,002 A * 12/1953 Silverman ..... A61F 5/01 450/102
2,803,823 A * 8/1957 Broadwin ..... A41D 7/00 450/11
2,854,669 A * 10/1958 Cohen ..... A41D 7/005 2/403
2,898,918 A * 8/1959 Roura ..... A41B 9/04 450/122
3,127,896 A * 4/1964 Puliafico ..... A41D 1/06 450/95
3,141,458 A * 7/1964 Burbank ..... A41D 7/005 2/238
3,177,877 A * 4/1965 Popp ..... A41C 1/08 450/142
3,185,158 A * 5/1965 Gattuso ..... A41F 9/025 450/95
3,333,589 A * 8/1967 Cohen ..... A41D 7/005 450/118
3,710,801 A * 1/1973 Bienenfeld ..... A41C 1/02 450/123

(Continued)

*Primary Examiner* — Heather Mangine
(74) *Attorney, Agent, or Firm* — Defillo & Associates, Inc; Evelyn A. Defillo

(57) ABSTRACT

A bathing suit-type garment with an integrated shaping girdle configured to apply pressure on the tissues or skin of a wearer. Likewise, the girdle integrated into the bathing suit can come into contact with water whether it be pools, sea, lagoons, among non-limiting examples, without the possibility of compromising its shape, integrity, and/or compressibility, furthermore, the girdle is discreetly and integrally integrated into a design of a brief-type swimsuit/bathing suit.

5 Claims, 6 Drawing Sheets

(56) References Cited

U.S. PATENT DOCUMENTS 4,875,236 A * 10/1989 Boynton ..... A41D 7/00 2/403
4,956,878 A * 9/1990 Boynton ..... A41D 7/00 450/11
5,351,340 A * 10/1994 Aldridge ..... A61F 5/028 2/81
5,513,393 A * 5/1996 Ferreira ..... A41C 1/003 450/97
5,590,548 A * 1/1997 Osborne ..... D04B 1/102 66/177
5,762,535 A * 6/1998 Nishiyama ..... A41C 1/003 2/400
5,888,118 A * 3/1999 Kishi ..... A41D 1/06 450/156
5,978,963 A * 11/1999 Moskowitz ..... A41C 1/08 450/95
5,996,120 A * 12/1999 Balit ..... A41D 13/0017 2/243.1
6,205,591 B1 * 3/2001 Wheeler ..... A41D 1/06 2/227
6,367,086 B1 * 4/2002 Woodard ..... A41C 1/08 2/237
6,766,533 B1 * 7/2004 Meier ..... A41D 7/00 450/133
10,709,177 B2 * 7/2020 Shoemaker ..... A41B 9/04
2010/0192283 A1 * 8/2010 Kim ..... A41D 1/06 2/338
2011/0078839 A1 * 4/2011 Leonard ..... A41D 27/02 2/67
2011/0099677 A1 * 5/2011 Mamiye ..... A41D 27/02 2/400
2012/0266347 A1 * 10/2012 DiLorenzo ..... A41D 7/00 450/95
2014/0051332 A1 * 2/2014 Schindler ..... A41C 1/06 450/154
2015/0020287 A1 * 1/2015 Liu ..... A41B 9/001 2/69
2015/0201682 A1 * 7/2015 Musciacchio ..... A41D 7/00 2/67
2015/0366270 A1 * 12/2015 Delgado ..... A41C 1/00 450/95
2016/0113334 A1 * 4/2016 Roup ..... A41D 1/067 450/156
2016/0353812 A1 * 12/2016 Shoemaker ..... A41B 9/04
2016/0361190 A1 * 12/2016 Caden ..... A41C 1/10
2017/0027252 A1 * 2/2017 Inzer ..... A41B 9/001
2017/0258159 A1 * 9/2017 Moore ..... A41F 9/02
2017/0318864 A1 * 11/2017 Carroll ..... A41B 9/04
2019/0110525 A1 * 4/2019 Conte ..... A41D 1/06
2019/0246717 A1 * 8/2019 Fischer ..... A41D 27/00
2020/0260808 A1 * 8/2020 Waldman ..... A41D 27/02
2021/0153573 A1 * 5/2021 Shams ..... A41D 7/00
2023/0113641 A1 * 4/2023 Perez Camberos ..... A41B 9/06 2/67
2023/0225427 A1 * 7/2023 Klabunde ..... A41D 7/00 2/67

* cited by examiner

FIG. 1A
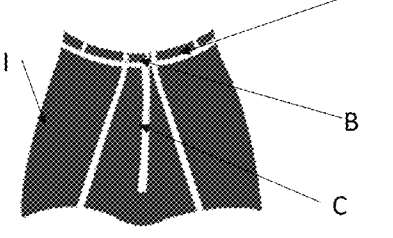
FIG. 1B
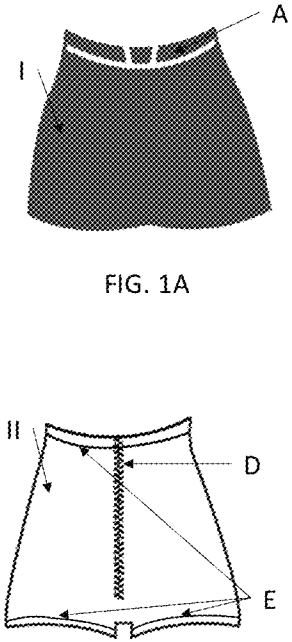
FIG. 2A
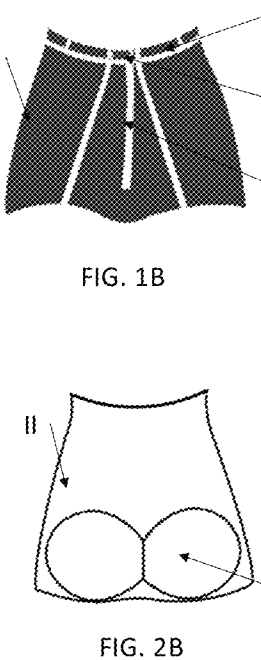
FIG. 2B
FIG 3
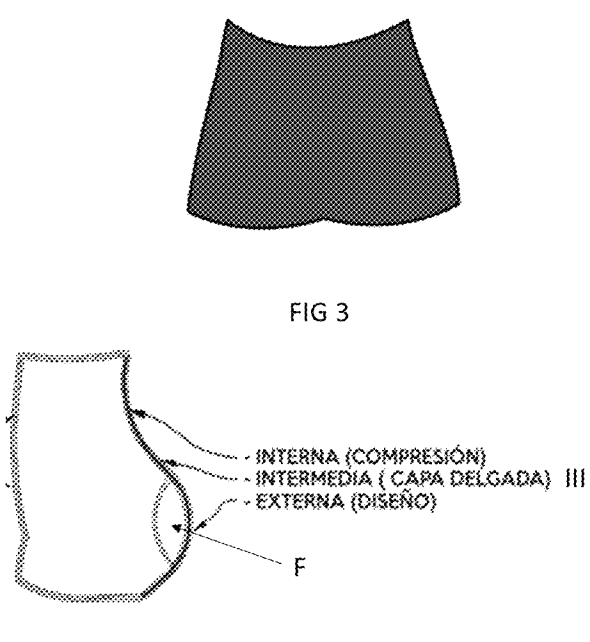
FIG 4

BATH GRIDLE BRIEFS

FIELD OF THE INVENTION

The present invention is catalogued within the class of garment making, and specifically in the category of garments used in the practice of swimming or with uses such as sunbathing. The particularity of the invention is the integration of a shaping girdle with a bathing suit, configured to apply pressure on the skin tissues and muscle firming of the wearer.

BACKGROUND OF THE INVENTION

Usually, the girdles are used by a female public who prefer to use them in order to give a better shape to their body, the girdles in their main design have been configured to be worn underneath the clothing, so most of the times they lack confection design to be worn only as a garment.

There are similar products in the state of the art, for example, U.S. Pat. No. 5,762,535 describes a garment made of flexible material configured to adapt to the body of a user and compress hips, buttocks, abdomen, and chest, avoiding limiting or restricting the movement of the user's body; which can be applied in the form of a bathing suit, which can also be full body (one piece), truss (bikini type), shorts, blouse (for upper body) among others. Likewise, U.S. Pat. No. 10,709,177 discloses a complete bathing suit (one-piece) for women that includes a girdle-type upper portion (bodice or corset) (upper body compression) and a brief-type lower portion. Said upper portion allows to adapt and compress the abdomen and chest of the user (analogously to a girdle) and said lower portion adjusts to the body of the user by means of connectors. The bathing suit can be simply put on since it does not need to be pulled up or put on like a conventional one-piece suit, its adjustment device allow to adapt it to the user's body, as well as to adjust it to a desired compression.

Said inventions present different shortcomings, essentially that these and other commercial products do not include an adjustment device, for example, through snaps that are used subsequent to placing the bathing suit on the user's body. In other words, the existing products do not have an adjustment component that is not included in the fabric itself, so that the user must pull the suit up to its final position by forcing it up.

SUMMARY OF THE INVENTION

The present invention has the purpose of overcoming the deficiencies of the prior art, the invention consists of a bathing suit type garment in a brief configuration and integrating a shaping girdle, which can be in contact with water for prolonged periods of time without compromising the integrity of the shape, material, compression capacity, along with the fact that the girdle is discreetly and functionally arranged, with multiple adjustment and fastening devices, such as buckle, zipper hooks, row of snaps and silicone adjusters for tactile attachment to the skin. In addition to using a layered arrangement of different materials that fulfill different functionality and purpose. To go into detail on the arrangement of each of the elements, the following will be explained in greater detail.

The bathing suit of the present invention can be used by postpartum or postoperative users, since the integrated girdle also favors the return of the organs and/or tissues to their original position, as well as reducing swelling or bruising, edema and/or fluid retention resulting from a surgical intervention and/or childbirth, besides providing support to the abdomen and back, helping to reduce pain and discomfort and without limiting the movement of the user and/or causing circulatory complications during its use. Moreover, the garment of the present invention is not limited to use in postpartum or postoperative users, it can be used in addition by users without any surgical intervention, c-section, or normal childbirth for the purpose of reducing size and/or shaping the body figure showing a stylized "hourglass" figure as well as improving their posture.

In another objective of the present invention, the girdle included in the bathing suit comprises lower sections in the lower back area where there is an area in the form of cavities, which allows an adjustment from the lumbar area of the user which allows giving greater firmness to said area of the body. In addition to providing support to the lower back, the cavities allow highlighting the buttocks due to the firmness focused on the adjustment in the lumbar area and toning the gluteal area.

Another objective of the present invention is focused on the integration of the girdle, which allows to provide ergonomic compression on the tissue or skin of the lower trunk area (lower back and abdomen) of the user, and at the same time helps to reduce fluid retention. Likewise, the present invention is comfortable and simple to use since it allows free movement while providing support to the muscles of the buttocks, torso and back.

These and other objectives will be apparent to those of ordinary skill in the art to which the present invention pertains, based on the following detailed description, the accompanying figures, as well as the appended claims.

BRIEF DESCRIPTION OF THE FIGURES OF THE INVENTION

Having previously and generally described the invention, reference will now be made to the attached drawings showing representative embodiments of the present invention, wherein:

FIG. 1A shows a rear view of a mode of the outer layer (brief-type bathing suit) in accordance with the present invention;

FIG. 1B shows a from view of a mode of the outer layer (brief-type bathing suit) in accordance with FIG. 1A;

FIG. 2A shows a front view of a mode of the inner layer (girdle) of the bathing suit in accordance with the present invention;

FIG. 2B shows a rear view of a mode of the inner layer (girdle) of the bathing suit in accordance with FIG. 2A;

FIG. 3 shows a rear view of the intermediate layer in accordance with one embodiment of the present invention.

FIG. 4 shows a side view of the different layers comprising the bathing suit of the present invention.

DETAILED DESCRIPTION OF THE INVENTION

Some aspects of the present invention will now be described in more detail with reference also to the attached drawings which show some, but not all, of the advantages of the present invention. In fact, the invention may be expressed in various modalities with different forms and the descriptions below optionally express the modalities described herein, for which reason they should not be considered as limiting and as a single modality of the present invention. Rather, these exemplary modalities are provided so that this invention is comprehensive and complete, and fully conveys the scope of the invention and its objects of protection for those skilled in the art. As used in the description and the appended claims, the singular forms "a", "an", "the", include plural referents unless the context clearly indicates otherwise, likewise referring to the garment device also referring to the bathing suit in the present invention. Further, when referring to "the person", "the user" or "the wearer" should be understood as the individual who will wear or carry the garment or bathing suit of the present application.

With reference to the Figures, the garment of the present invention is made up of three different layers. In FIGS. 1A, front part and FIG. 1B, rear part, the first layer or outer layer (I) is shown, which corresponds to a bathing suit of the brief type, which due to its characteristics covers half the torso of the person up to the legs, the suit is held by a belt (A) with adjustment at the waist.

Figure 5:
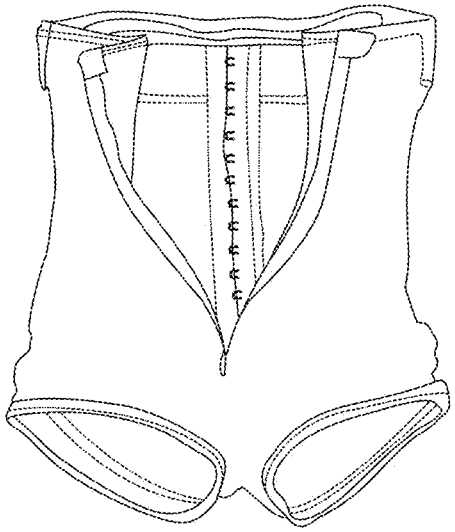
FIG. 5 shows a front view of one of the possible embodiments of the outer layer (bathing suit) in accordance with the present invention.

Preferably in the center is a fastening or closure device (C) which can be a zipper, snaps, hooks, or any suitable closure device. At the top there is also a fastening device in the form of a clasp (B), which may be a hook, clasp, or any suitable fastening device. The fastening or clasping device B and C allow for proper fit of the bathing suit, while providing further support and compression to the lower trunk region (abdomen and lower back) specifically on the skin and muscles of the person. FIG. 5 shows another embodiment of the bathing suit, wherein the outer layer, in accordance with the present invention, is mainly observed.

Figure 8A:
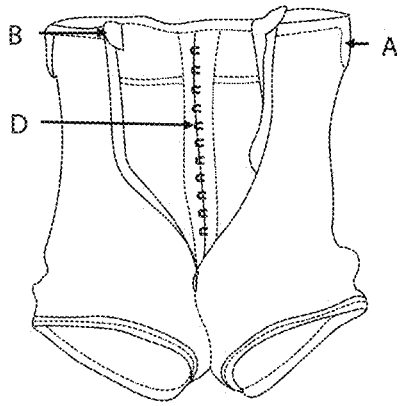
FIG. 8A shows the inner layer (girdle) wherein the preferred adjustment means according to the present invention can be appreciated.
Figure 8B:
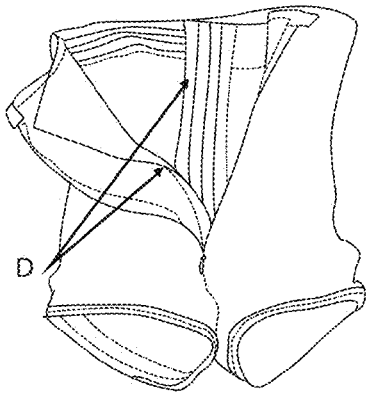
FIG. 8B shows the inner layer (girdle) wherein the preferred adjustment device according to the present invention can be appreciated.
Figure 9A:
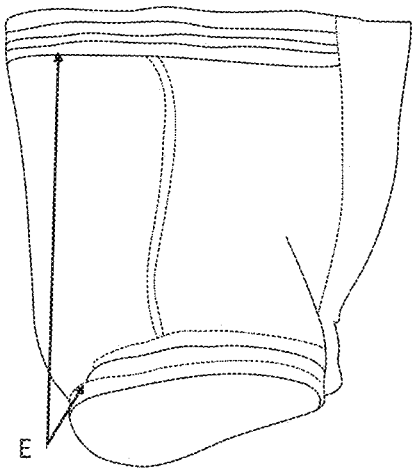
FIG. 9A shows a preferred embodiment of the adhesion fitting device in accordance with the present invention.
Figure 9B:
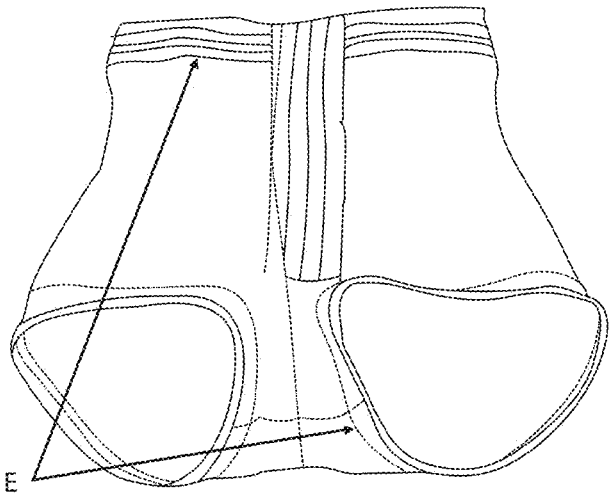
FIG. 9B shows another preferred embodiment of the adhesion fitting device in accordance with the present invention.

FIGS. 2A and 2B show one embodiment of the inner layer which refers precisely to the layer made up as a girdle (II). Said girdle (II) also comprises a closing device (D) in the center, which can also be a zipper, snaps, or any suitable closing device. For example, as shown in FIGS. 8A and 8B, the closing device (D) may be a set of at least one row of hooks which are adjustable according to the type of size of the wearer and to the pressure to be exerted on the skin and muscles in the abdominal part and back thereof, it also has an additional adherence device to the skin (E) such as silicone strips that have good adherence to the touch of the user's skin and give firmness, fit and toning.

Figure 6:
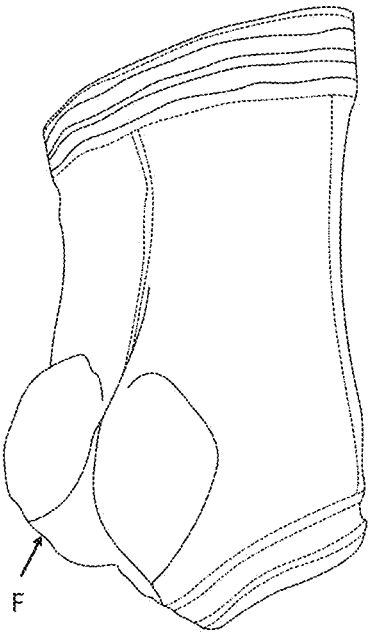
FIG. 6 shows another embodiment of the inner layer (girdle) in a reverse and back view, where the cavities between layers where the user's buttocks are positioned can be perceived, as well as the intermediate layer (brief) that tones the buttocks, in accordance with the present invention.

In the lower part of the girdle (II) that covers the lower back, there are a pair of cavities (F) in the gluteal region of the user to place the buttocks of this user, these cavities (F) are also adjustable by the type of material used to make the girdle, in this way the users can put on the bathing suit type briefs and have freedom of movement and comfort during use (FIG. 6).

Figure 7A:
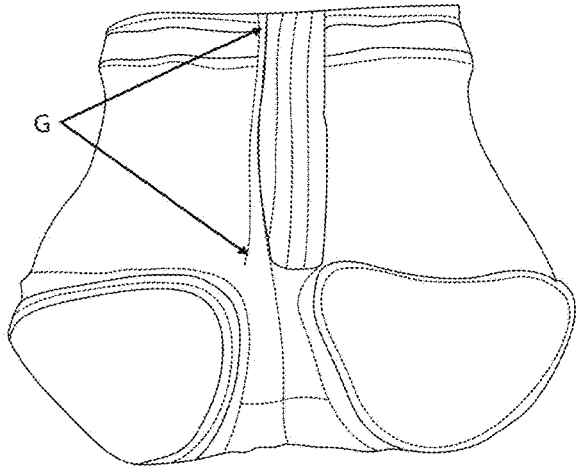
FIG. 7A shows attachment points of the inner layer (girdle), in accordance with the present invention.
Figure 7B:
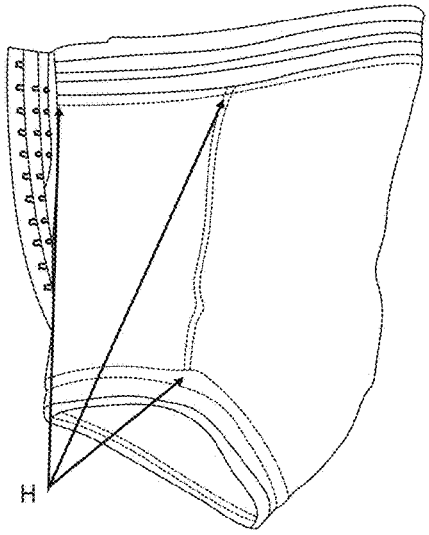
FIG. 7B shows more attachment points of the inner layer (girdle), in accordance with the present invention.
Figure 10:
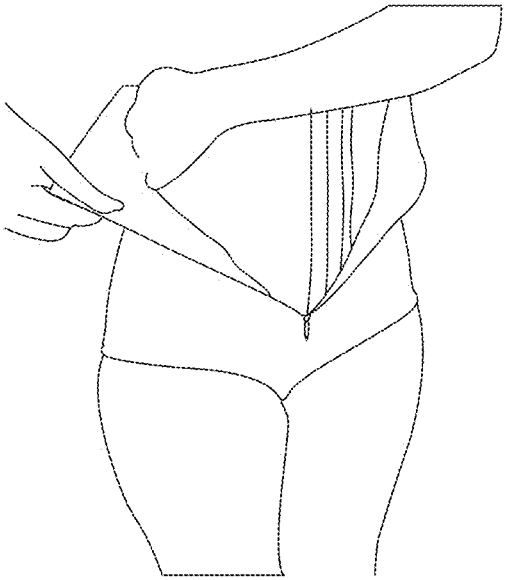
FIG. 10 shows the arrangement of both layers in accordance with the present invention.

The girdle (II) according to the present invention is attached to the outer layer (I) in such a way that it resembles an almost complete inner lining, however, in order to provide greater comfort and ease of donning, in one embodiment the girdle (II) is only attached by a seams device (H) which are located only at the bottom and at the top, respectively. That is, in the part of the thigh (below the buttocks) and/or in the part around the waist, as shown in FIGS. 7A and 7B. In this way the rest of the girdle (II) is free which facilitates its adjustment and prevents it from losing its integral shape and adjustability during prolonged use, an example of this is shown in FIG. 10.

As can be appreciated in FIGS. 3 and 4, the present invention comprises an intermediate layer (III) in the lower part, which functions as an additional cover that provides even greater support and enhancement to the buttocks. Said intermediate layer (III) is located at the back only, as detailed in FIG. 4, of the orifices in the gluteal region and is where the buttocks are incorporated.

Therefore, the bathing suit of the present invention is fitted in the ordinary way; for example, in a preferred mode, leaving the fastening device open, subsequently the girdle (II) is first adjusted by means of the fastening device D; subsequently the devices B and C are closed to complete the fitting of the bathing suit of the present invention and the fastening device (A) such as may be a belt or sash counts as an additional fastening device.

To those skilled in the art to which this invention pertains many modifications and other embodiments of the invention will occur which have the benefit of the teachings presented in the foregoing descriptions and associated drawings. Therefore, it should be understood that the specific embodiments of the invention are described herein in an enunciative but not limiting manner, and that there may be modifications and other embodiments that would be included within the scope of the appended claims. Although specific terms are used herein, they are used only in a generic and descriptive sense and are not intended to be limiting.

For example, the material from which the bathing suit and its various parts are made in accordance with the present invention may be any woven or non-woven, natural, or synthetic material that allows contact with water and provides also compression and fit in the trunk area (abdomen and mid-lower back) of the wearer using the present invention. Said materials may be polyester, nylon, or polyamide for the bathing suit, while the girdle may be made of powernet fabric.

Likewise, the various fastening or closing device described above are made of any material that can be totally or partially exposed to water without showing signs of oxidation or any type of deterioration.

The invention claimed is:

1. A bathing suit with a brief-type girdle adapted to cover a lower part of a trunk of a person up to legs, the bathing suit comprising:

a first layer (1) corresponds to an outermost surface of the bathing suit, which is held in place by a fastening clasp (B), a closure device (C) and an adjustment device adapted to be placed at a waist (A) of the person, the first layer (1) including a back part, a front part, and a bottom part;

a second layer (II) corresponding to the girdle and including a closure device (D), and a pair of lower cavities (F) adapted to accommodate buttocks of the person, the second layer (II) including an adjustment device adapted to be adhered to a skin (E) of the person;

a third layer (III) or an intermediate layer located at the back part of the first layer (1) behind the lower cavities (F);

wherein the second layer (II) is attached to the first layer (1) as an inner lining, and wherein the first layer (1) and the second layer (II) are attached to each other through seams (H) located only at the bottom part and the top part of the first layer (1), the seams (H) are configured to be below the buttocks and below the waist (A) of the person.

2. The bathing suit with the brief-type girdle according to claim 1, wherein the fastening clasps (B) and the closure device (C) of the first layer (I) are selected from the group consisting of a zipper, snaps, hooks, and cinch.

3. The bathing suit with the brief-type girdle according to claim 1, wherein the closure device (D) of the second layer (II) includes a set of adjustable rows of hooks.

4. The bathing suit with the brief-type girdle according to claim 1, wherein the first layer (I), the second layer (II), and the third layers are made of a woven material, a non-woven material, a natural material or a synthetic material.

5. The bathing suit with the brief-type girdle according to claim 1, wherein the bathing suit with the brief-type girdle is made of a material that can be immersed in water without showing signs of oxidation or deterioration.

* * * * *